United States Patent [19]

Yamaguchi et al.

[11] Patent Number: 4,923,315

[45] Date of Patent: May 8, 1990

[54] PRINTER WITH PRINT HEAD RELEASABLE AFTER PREDETERMINED AMOUNT OF SUCCESSIVE PRINTING OR ERASING

[75] Inventors: Koshiro Yamaguchi; Toshio Takahashi; Yasunori Kitazawa; Hiroshi Hattori, all of Nagoya, Japan

[73] Assignee: Brother Kogyo Kabushiki Kaisha, Japan

[21] Appl. No.: 198,313

[22] Filed: May 25, 1988

[30] Foreign Application Priority Data

May 29, 1987 [JP] Japan ..... 62-135380

[51] Int. Cl.[5] ..... B41J 3/20

[52] U.S. Cl. ..... 400/120; 400/234; 400/696

[58] Field of Search ..... 400/62, 74, 240.1, 692.1, 400/234, 236, 120, 696

[56] References Cited

U.S. PATENT DOCUMENTS

| | | | |
|---|---|---|---|
| 4,384,797 | 5/1983 | Anderson et al. . | |
| 4,396,308 | 8/1983 | Applegate et al. . | |
| 4,507,667 | 3/1985 | Tsuboi | 400/234 X |
| 4,571,100 | 2/1986 | Ueno et al. | 400/62 X |
| 4,590,486 | 5/1986 | Yana | 400/120 |
| 4,591,879 | 5/1986 | Yohoto et al. | 400/234 X |
| 4,613,248 | 9/1986 | Iwai et al. | 400/240.1 X |
| 4,616,945 | 10/1986 | Kamplin | 400/697.1 |
| 4,623,271 | 11/1986 | Kress | 400/234 X |
| 4,648,731 | 3/1987 | Iwai et al. | 400/240.1 |
| 4,650,351 | 3/1987 | Engle et al. | 400/234 X |
| 4,758,108 | 7/1988 | Kahain et al. | 400/697.1 |

FOREIGN PATENT DOCUMENTS

| | | |
|---|---|---|
| 31787 | 2/1983 | Japan . |
| 74368 | 5/1983 | Japan . |
| 131076 | 8/1983 | Japan . |
| 59-123683 | 7/1984 | Japan . |
| 114753 | 7/1987 | Japan . |

*Primary Examiner*—David A. Wiecking
*Assistant Examiner*—Steven S. Kelley
*Attorney, Agent, or Firm*—Oliff & Berridge

[57] ABSTRACT

A printer having a print head adapted to be pressed against or released from a print paper mounted on a platen, wherein a print operation or an erase operation is performed by moving the print head in press contact with the print paper through an ink ribbon. The improvement comprises control means for relasing the print head from the print paper after a predetermined amount of printing or erasing is successively performed with the print head being held in press contact with the print paper, thus preventing defective winding and meandering of the ink ribbon.

3 Claims, 4 Drawing Sheets

PRINTER WITH PRINT HEAD RELEASABLE AFTER PREDETERMINED AMOUNT OF SUCCESSIVE PRINTING OR ERASING

BACKGROUND OF THE INVENTION

The present invention relates to a printer in which a print head is provided to be pressed against or released from a print paper mounted on a platen to perform a print operation or an erase operation by moving the print head held in press contact with the print paper through a transfer medium such as an ink ribbon. This type of printer is disclosed in U.S. Pat. Nos. 4,384,797 and 4,396,308, for example.

Such a printer may include a thermal printer capable of performing the print operation by the flow of molten material from a transfer medium such as an ink ribbon to a print paper. Local heating of the transfer medium may be achieved by heating the print head or the transfer medium itself due to an electrical resistance against an electric current to be applied to the medium. A typical prior art thermal printer includes a carriage mounting thereon a thermal head (hereinafter referred to as "head" for short) and a ribbon cassette including a thermal ribbon (hereinafter referred to as "ribbon" for short) is wound on a supply spool and a take-up spool. The ribbon cassette is mounted on the carriage in such an arrangement that a portion of the ribbon exposed from the ribbon cassette may be located between the head and the platen. The carriage is movable along the platen.

In order to effect the print operation, the head is pressed against the platen through the ribbon and the print paper, and during the movement of the carriage held in this condition, the ribbon is heated to cause ink of the ribbon to melt and adhere to the print paper. Then, the ribbon is separated from the print paper to transfer the molten ink to the print paper. During this print operation, the ribbon is unwound from the supply spool and travels in a nipped condition between the head and the print paper to be wound onto the take-up spool.

In recent years, a thermal printer with an erase capability has been gradually put in practical use. In an example of this type printer, a single ribbon is used to effect both the print operation and the erase operation. In many cases, such a printer employs a ribbon having ink so formulated as to melt at a predetermined temperature and generate an adhesive force at an intermediate temperature between the print temperature and the room temperature. In the print operation, the ribbon is heated to the print temperature to transfer the ink of the ribbon onto the print paper, while in the erase operation, a character equal to that having been already printed or a solid mark as covering the periphery of such a printed character is reprinted on the printed character. When the temperature of the ribbon reaches the intermediate temperature, the ribbon is separated from the print paper, so that the adhesive force is generated in the ink on the print paper at this intermediate temperature to cause the ink of the printed character to adhere to the ribbon and be stripped off from the print paper.

The ribbon may be cooled to the intermediate temperature by various means such as by providing a correction blade for holding the ribbon having been heated by the head in contact with the print paper, while the head moves a predetermined distance, so that the ribbon may be cooled to the intermediate temperature during the movement of the head. Such a correction blade is disclosed in Japanese Utility Model Laid-Open Publication No. 62-114753, and the corresponding U.S. Application was filed on Dec. 29, 1986 (Ser. No. 947,915). This copending commonly owned application is a part of the disclosure of this application. There is provided another means wherein only during the erase operation, a moving speed of the carriage is reduced so as to prolong the period of time between heating of the ribbon and separating of the ribbon from the print paper and thereby provide an extra time for the cooling. In any cases as mentioned above, the adhesion is developed between the ribbon and the printed character, that is, there is generated a force acting to prevent ready separation of the ribbon from the print paper. As described above, a relatively strong adhesion is developed in the erase operation, and even in the print operation, melting and transfer of the ink causes adhesion between the ribbon and the print paper.

Conventionally, such a printer successively effects the print operation or the erase operation with no waiting steps interposed. Especially in a ribbon having improved print qualities for a rough print paper, the adhesive force of the ink is so high as to generate a close contact force to be developed between the ribbon and the print paper, and if the take-up force for the ribbon is not sufficient, the ribbon may stay in contact with the paper to be prevented from separation therefrom during the successive print or erase operation, which will result in defective winding of the ribbon.

Furthermore, as the ribbon moves in a nipped condition between the head and the print paper, any bias of the pressure distribution in the contact area between the head and the print paper will direct the force applied to the ribbon toward a portion under a lower pressure along the width of the ribbon. Consequently, during the successive print operation using a long ribbon, the ribbon will be gradually deviated from the normal travelling path to cause meandering, and in a serious case, it runs off the head, resulting in incapability of any further print operation.

Also, in the case that the used area of the ribbon along the width thereof is partial such as when printing a continuous underline, that is, in the case that the load generated between the ribbon and the print paper when the ribbon is separated from the paper is unbalanced along the width of the ribbon, such meandering will similarly occur.

In the erase operation, a relatively strong adhesion is developed to effect erasing as described above, resulting in a greater liability of defective winding and meandering.

SUMMARY OF THE INVENTION

Accordingly, it is an object of the present invention to provide a printer which can prevent the defective winding and meandering of the ribbon and effect a reliable printing and erasing operation, eve when there is developed a strong adhesion between the ink ribbon and the print paper, or when there is generated a bias of the pressure distribution in the contact area between the print head and the print paper, or when the used area of the ribbon is partial along the width thereof.

According to the present invention, there is provided in a printer having a print head adapted to be pressed against or released from a print paper mounted on a platen, wherein a print operation or an erase operation is performed by moving the print head in press contact with the print paper through an ink ribbon, the improvement comprising control means for releasing the print head from the print paper after a predetermined amount of printing or erasing is successively performed with the print head being held in press contact with the print paper.

In the print or erase operation of the printer thus constructed, the control means operates to release the print head after a predetermined amount of printing or erasing is successively performed with the print head being held in press contact with the print paper, so that the ribbon nipped between the print head and the print paper is disengaged. Thus, the ribbon can be adjusted to the normal position to be prevent from serious deviation and thereby to prevent the defective printing or erasing from occurring.

The invention will be more fully understood from the following detailed description and appended claims when taken with the drawings.

DETAILED DESCRIPTION OF THE PREFERRED EMBODIMENT

Figure 1:
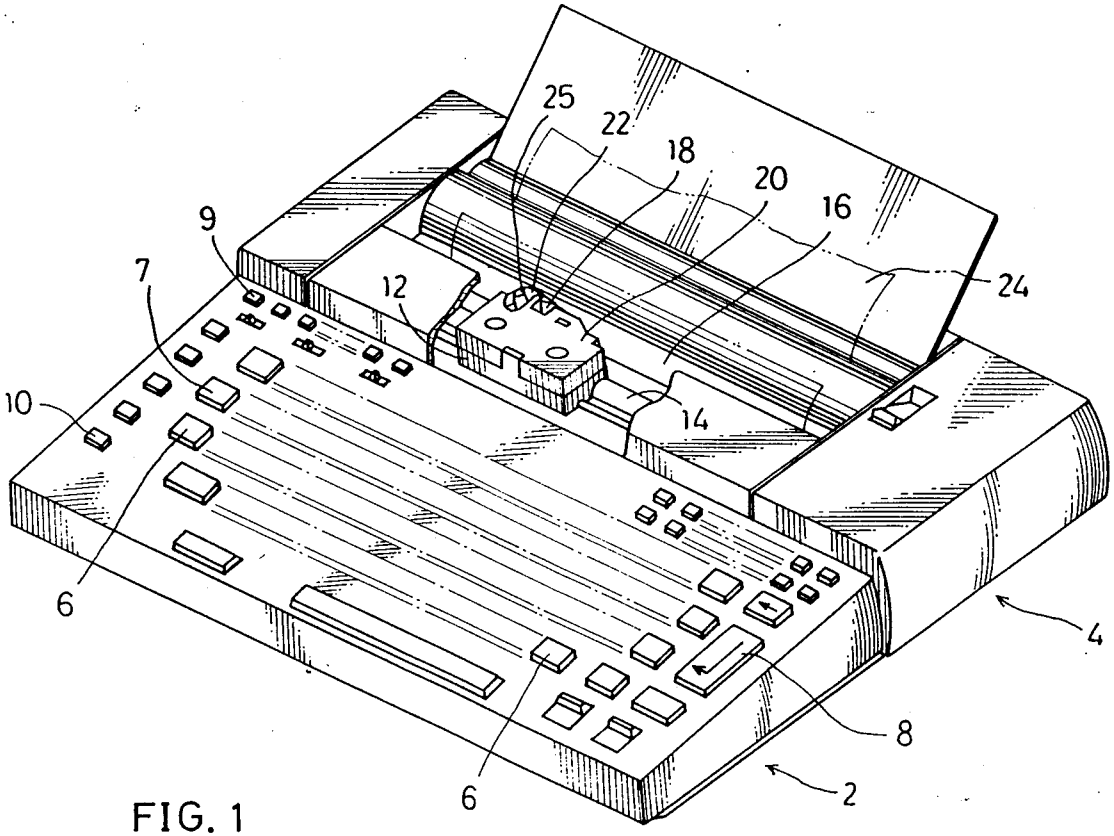
FIG. 1 is a schematic perspective view of an electronic typewriter with the erase capability including a printer of a preferred embodiment according to the present invention.

Referring to FIG. 1, the electronic typewriter shown includes a keyboard 2 and a thermal printer 4. The keyboard 2 includes various keys such as character keys 6, tab key 7, carriage return key 8, underline key 9, and one-line correction key 10 for generating a command of erasing printed characters in a line from the leftmost one to the character at the location of a thermal head 18 which will be hereinafter described. The thermal printer 4 can perform printing and erasing in accordance with data or command inputted by these keys on the keyboard 2.

The thermal printer 4 includes a carriage 12 guided by a guide bar 14 to be movable along a platen 16. The carriage 12 supports the thermal head 18 serving as a print head. When the thermal head 18 is pressed against a print paper 24 through an ink ribbon 22 drawn out from a ribbon cassette 20 mounted on the carriage 12, ink on the ribbon 22 is thermally molten and transferred onto the paper 24. The carriage 12 further supports a correction blade (ribbon guide) 25 disposed at a predetermined distance from the thermal head 18 along the print line for guiding the ribbon 22 and preventing the ribbon 22 from separating from the paper 24 until the thermal head 18 heated is cooled to a predetermined temperature in the erase operation. The correction blade 25 is movable toward and away from the platen 16.

Figure 2:
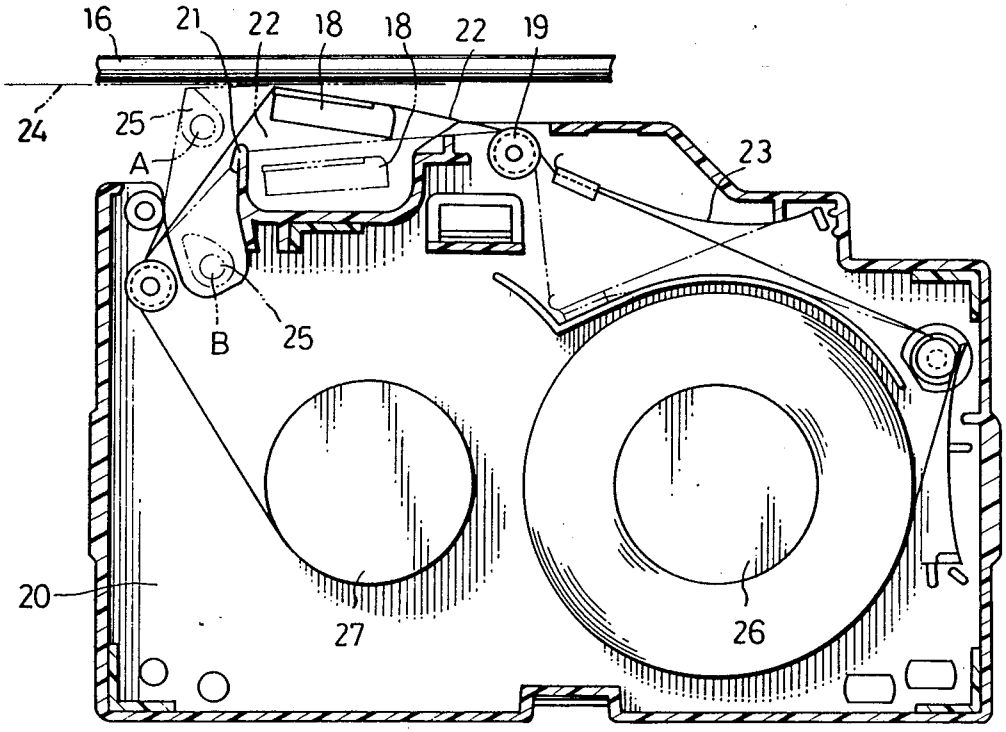
FIG. 2 is an enlarged sectional view of a ribbon cassette mounted on a carriage.

Now, the construction around the thermal head 18 will be described in more detail. As shown in FIG. 2, with the ribbon cassette 20 mounted on the carriage 12, the thermal head 18 is supported movably between an active position wherein it is pressed against the print paper 24 through the ribbon 22 and a release position wherein it is apart from the paper 24 and the ribbon 22. The thermal head 18 and the ribbon 22 in the active position are shown by a solid line, while these members in the release position are shown by a phantom line. When the thermal head 18 held under the pressed condition in the active position moves along the platen 16 with the movement of the carriage 12, the ink of the ribbon 22 is heated by the thermal head 18 to be molten and transferred onto the paper 24.

The correction blade 25 is provided at a predetermined distance from the thermal head 18 along the print line and movable between positions A and B in FIG. 2. When the correction blade 25 is advanced to the position A, the ribbon 22 heated by the thermal head 18 is held in press contact with the paper 24 by the correction blade 25, and this period of contact with the paper 24 permits the ribbon 22 to be cooled to an intermediate temperature suitable for erasing. Then, the ribbon 22 clears the correction blade 25 and is directed away from the paper 24, and at this time, the ribbon 22 strips off the ink on the paper 24 by using the adhesive effect developed between the ink on the paper 24 and the ribbon 22 to complete the erasing.

The ink of the ribbon 22 in this embodiment is so formulated as to melt at a predetermined print temperature and produce the adhesive effect at an intermediate temperature between the print temperature and the room temperature. When a character equal to a printed character to be erased is reprinted on the printed character or a solid mark is reprinted on a printed character to be erased, the ink of the ribbon 22 in the area in contact with the ink of the printed character on the paper 24 is once molten, but while the print head 18 moves a distance between the thermal head 18 and the correction blade 25, the ink is cooled to the intermediate temperature to produce the adhesive effect, which cause the printed character on the paper 24 to be stripped off by the ribbon 22 and thereby to be erased.

As shown in FIG. 2, the ribbon 22 is wound on a supply spool 26 and a take-up spool 27 both rotatably supported in the ribbon cassette 20, and the ribbon 22 is nipped between the thermal head 18 and the paper 24 on the platen 16, so that when the thermal head 18 is moved together with the carriage 12, the ribbon 22 is unwound from the supply spool 26 and is wound onto the take-up spool 27 by a ribbon take-up mechanism (not shown). The ribbon 22 is adjusted to be kept under a certain tension by a leaf spring 23.

When the thermal printer 4 thus constructed is used to successively print or erase a line of characters, any bias of the pressure distribution in the contact area between the thermal head 18 and the paper 24 and/or partial use of the ribbon 22 such as in the underline print operation will cause the ribbon 22 to be subject to a force acting along the width thereof, so that after printing of a line of characters, the ribbon 22 may be deviated from the normal travelling path to cause meandering. During the erase operation, the pressure distribution between the correction blade 25 and the print paper 24 as well as the adhesion between the ribbon 22 and the paper 24 constitutes additional factors to increase the liability of meandering.

If the take-up force imparted by the take-up mechanism is not sufficient in relation to the contact force between the ribbon 22 and the paper 24, successive printing or erasing may cause the ribbon 22 to adhere to the paper 24 to be prevented from separation therefrom, with the result of defective winding-up of the ribbon 22.

Figure 3:
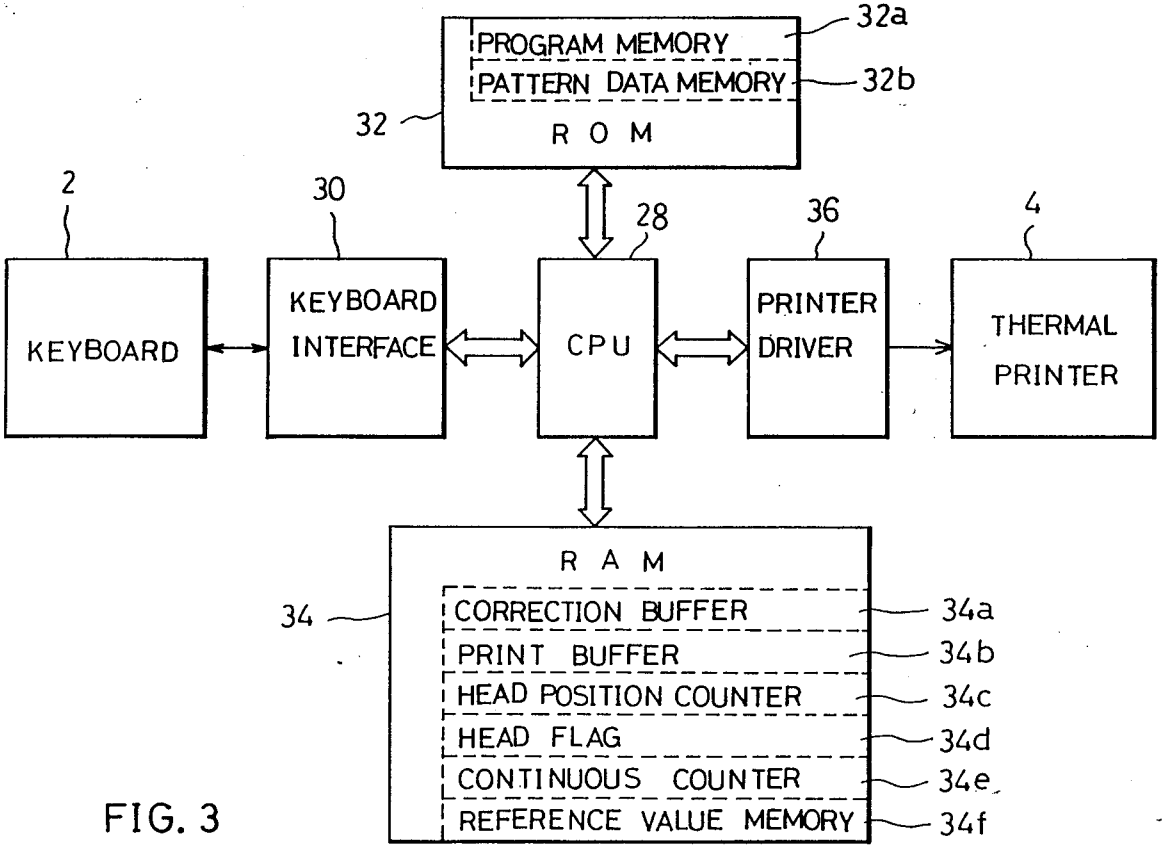
FIG. 3 is a block diagram of the control system of the electronic typewriter shown in FIG. 1.

In order to eliminate the above problems, the electronic typewriter with the erase capability according to the present invention comprises a control means which will now be described. FIG. 3 shows an embodiment of the control means including a CPU 28 connected through a keyboard interface 30 to the keyboard 2 and also connected to a ROM 32 and a RAM 34.

The ROM 32 includes a program memory 32*a* for storing program for controlling the operation of the typewriter and a pattern memory 32*b* for storing pattern data for letters and numerals corresponding to various code data.

The RAM 34 includes a correction buffer 34*a* having a predetermined capacity such as for one print line or more to sequentially store data inputted by the keyboard 2, a print buffer 34*b* for receiving and storing the printing or erasing data stored in the correction buffer 34*a*, a head position counter 34*c* for indicating the position of the thermal head 18 along the platen 16, a head flag 34*d* to be set when the thermal head 18 is pressed against the platen 16 and be reset when it is released, a continuous counter 34*e* for counting the number of characters printed or erased succesively by the thermal head 18, a reference value memory 34*f* for storing the reference number of characters (eight in this embodiment) for use in releasing of the thermal head 18.

The CPU 28 is further connected through a printer driver 36 to the thermal printer 4, so that printing or erasing may be effected in accordance with the command from the CPU 28.

In the operation of the control means thus constructed, the following processes are carried out under the control of the CPU 28 according to the program stored in the program memory 32*a*.

In the processes, data inputted by the keyboard 2 is sequentially stored in the correction buffer 34*a* and transferred to the print buffer 34*b*.

The print buffer 34*b* has a data storage area of a predetermined capacity, and is controlled by a write pointer indicating the address for writing the data and a read pointer indicating the address for reading the data. The write pointer is incremented by one (i.e., one storage area) every time the data is stored, and when it reaches the final data storage address, it is controlled to point the initial address. The read pointer is controlled to change the address every time the printing or erasing of one character by the thermal printer 4 is executed. Since the printing or erasing is executed after the data is inputted, the read pointer changes its address in such a manner as to follow the write pointer, and when the addresses of both the pointers coincide with each other, it will be understood that the process of printing or erasing has been completed.

When the one-line correction key 10 is depressed, the data corresponding to the command of the one-line correction key 10 is written in the correction buffer 34*a*, and the data stored in the correction buffer 34*a* from the address corresponding to the leftmost position of the print line to the address corresponding to the print head position indicated by the head position counter 34*c* is transferred as an erase data to the print buffer 34*b*.

Now, the control procedure of the thermal printer 4 by the above described control means will be described with reference to FIG. 4.

Figure 4:
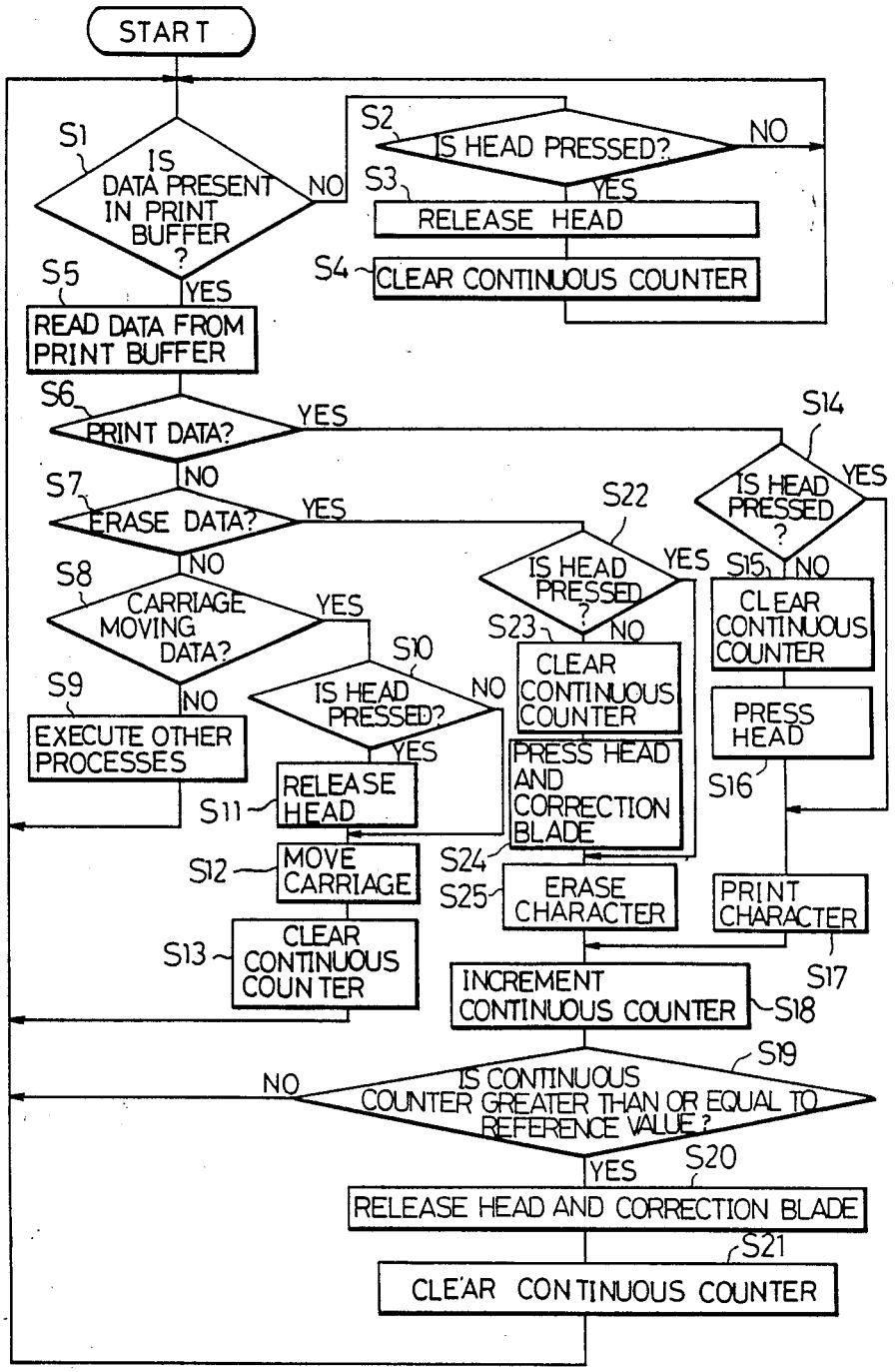
FIG. 4 is a flow chart of the operation of the program stored in the program memory shown in FIG. 3.

FIG. 4 shows a flow chart for the control operation for the head. This process is executed as a subroutine in relation to a main routine (not shown). The main routine is for conducting data processing required for a usual typewriter such as discrimination of an input signal from the keyboard 2 and storage of the input signal in the correction buffer 34*a* and the print buffer 34*b*. The subroutine in FIG. 4 is periodically executed as an interruption routine during the execution of the main routine. The subroutine is mainly executed according to the data stored in the print buffer 34*b*. In this embodiment, after execution of steps S4, S9, S13 and S21, the program returns from the subroutine to the main routine. Also during the execution of the steps such as S11, S12 and S24 where mechanical movements or time-consuming proessing are performed, the program temporarily returns to the main routine to achieve a high-speed processing.

In step S1 of the subroutine, it is determined whether or not there is any data to be processed at the position indicated by the read pointer of the print buffer 34*b*. If there is no data to be processed, that is, if the positions indicated by the read pointer and the write pointer coincide with each other, the determination is NO, and the program proceeds to step S2 where it is determined whether the thermal head 18 is in contact with or apart from the platen 16 according to the head flag 34*d*. If the head 18 is released, that is, if the head flag 34*d* is reset, the program returns to the main routine. If the head flag 34*d* is set, the program proceeds to step S3 where the thermal head 18 is released and the head flag 34*d* is reset and then the program proceeds to step S4 where the continuous counter 34*e* is cleared, and then returns to the main routine.

If there is any data to be processed in the print buffer 34*b*, the program proceeds to step S5 where the data is read, and it is determined in steps S6, S7 and S8 whether the read data is a print data such as of letters and numerals, erase data, or carriage moving data, respectively. If the read data does not conform with any of them but is other data corresponding to the underline key 9, for example, the program proceeds to step S9 where the other processing is performed and the underline mode is set in this case. Then, the program returns to the main routine.

If the read data is a data for the movement of the carriage 12 with the thermal head 18 released from the platen 16 corresponding to the tab key 7 and the carriage return key 8, for example, the determination in step S8 is YES, and the program proceeds to step S10 where it is determined whether the thermal head 18 is pressed against or apart from the platen 16. If it is pressed, the program proceeds to step S11 where the thermal head 18 is released and the head flag 34*d* is reset, and then the program proceeds to step S12. If it is released, the program proceeds to step S12 where the movement of the carriage is carried out in accordance with the data. Thereafter, the program proceeds to step S13 where the continuous counter 34*e* is cleared, and returns to the main routine.

If the thermal head 18 is released and the character keys 6 are sequentially depressed to permit a number of print data to be stored in the print buffer 34*b* in the main routine, the program first proceeds to step S5 where the first one of the series of print data is read, and then proceeds to step S6. At this time, the determination of step S6 is YES, and the program proceeds to step S14 where it is determined whether the thermal head 18 is pressed against or released from the platen 16. At first, as the thermal head 18 is in the released position, the determination is NO. Then, the program proceeds to step S15 where the continuous counter 34*e* is cleared, and proceeds to step S16 where the thermal head 18 is pressed against the platen 16 and the head flag 34*d* is set. Then, the program proceeds to step S17 where pattern data corresponding to the read print data is read from the pattern data memory 32*b* to cause the thermal printer 4 to effect printing of the pattern by moving the carriage 12. Then, the program proceeds to step S18 where the continuous counter 34*e* is incremented by one. In step S19, the count value of the continuous counter 34*e* is compared with the reference value "8" stored in the reference value memory 34*f*. In this case, as the continuous counter 34*e* has been cleared in step S15, the count value of the continuous counter 34*e* is "1", and the determination in step S19 is NO, so that the program returns to step S1.

Then, the program proceeds to step S5 where the second one of the series of print data is read, and at this time, as the thermal head 18 is in the pressed condition, the determination in step S14 is YES, so that the program skips steps S15 and S16, and proceeds to step S17 where the printing corresponding to the print data is executed. In step S18, the count value is incremented to "2" which is smaller than the reference value "8", so that the determination of step S19 is NO, and the program returns to step S1.

The others of the series of print data are processed in the same way as the second data, but when the printing corresponding to the eighth print data in the series is performed in step S17, the count value of the continuous counter 34*e* is incremented to "8" in step S18, so that the determination of step S19 is YES, and the program proceeds to step S20 where the thermal head 18 is released from the platen 16 and the head flag 34*d* is reset, and then proceeds to step S21 where the continuous counter 34*e* is cleared, and returns to step S1.

Thus, the thermal head 18 has been released in step S20 in association with the eighth data, so that when the ninth data of the series of print data is read in step S5, the determination of step S14 is NO, and the ninth data is processed in the same way as the first data. In this way, the thermal head 18 is released every time the eighth character is printed.

Thus, the thermal head 18 is released from the platen 16 every time the eight characters have been sequentially printed, so that even if any defective winding and/or meandering of the ribbon 22 begins to occur upon printing of the eighth character when the ribbon 22 is released from nipping between the thermal head 18 and the print paper 24, the ribbon 22 ca be separated from the paper 24 to return to its normal travelling path by the tension applied thereto by the leaf spring 23 and a self-aligning force. Therefore, any defective winding and meandering may be prevented from becoming more serious.

The erase operation is processed basically in the same way as the print operation.

In the erase operation, when the one-line correction key 10 is depressed, the data corresponding to the key 10 and a part of the print data of characters having been already printed in the print line from the leftmost position of the line to the position where the thermal head 18 is now located are transferred as an erase data from the correction buffer 34*a* to the print buffer 34*b*. Although not shown in the flow chart of FIG. 4, when the data corresponding to the one-line correction key 10 stored in the print buffer 34*b* is read, this causes the carriage 12 to move so as to locate the thermal head 18 at the leftmost position in the print line.

The program proceeds to step S5 where the first one of the erase data thus transferred is read. At this time, the determination of step S7 is YES, so that the program proceeds to step S22. As the thermal head 18 and the correction blade 25 are at first in the released position, the determination of step S22 is NO, and the program proceeds to step S23 where the continuous counter 34*e* is cleared, and proceeds to step S24 where the thermal head 18 and the correction blade 25 are pressed against the platen 16, and then proceeds to step S25 where the pattern data corresponding to the erase data is read from the pattern data memory 32*b* to cause the thermal printer 4 to effect erasing by moving the carriage 12. Thereafter, the program proceeds to step S18 where the continuous counter 34*e* is incremented. Then, the program proceeds to step S19 and in the case of erasing the first character, the determination of step S19 is NO.

As to the other subsequent erase data, steps S23 and S24 are skipped in the same manner as the case in the print process. When the eighth erase data in the series is read, the determination of step S19 is YES, so that the program proceeds to step S20 where the thermal head 18 and the correction blade 25 are released from the platen 16, and then proceeds to step S21 where the continuous counter 34*e* is cleared.

Thus, detective winding and/or meandering of the ribbon 22 can be prevented during the erase operation as well as during the print operation. As above described, during the erase operation, the bias of the pressure distribution between the correction blade 25 and the platen 16 and the increase in adhesion developed between the ribbon 22 and the print paper 24 constitute additional factors for causing the meandering and defective winding of the ribbon, but it will be understood that the system of the present invention can effectively prevent such defective winding and meandering of the ribbon.

In this embodiment, the single reference value of eight characters is used to cause the head to be released both in the print operation and in the erase operation, but respective reference values may be properly set in accordance with the liability of defective winding and meandering in the print operation and the erase operation.

In the case of using a ribbon which is free from defective winding and meandering during the print operation, the system of the present invention may be applicable only to the erase operation. In such a case, in place of counting the number of erased characters in every erase operation as described in this embodiment, the number of erase data transferred from the correction buffer 34*a* to the print buffer 34*b* may be counted, and every time the count value reaches a reference value, a command code of releasing the thermal head and the correction blade may be generated to be inserted between the erase data, and then stored in the print buffer 34*b*.

In the case that the occurrence of defective winding and meandering depends on the environmental temperature, suitable temperature detecting means such as thermistor may be provided to change the reference value in response to the detected value.

In place of counting of characters as described in this embodiment, the number of dots constituting characters may be counted, so that the reference value for use in releasing of the head may be set in accordance with the dispersion, density or the like of the dots.

Furthermore, a timer may be used to count the time of successive print or erase operation, so that when a predetermined period of time elapses, the head may be released.

Having thus described the preferred embodiment of the invention, it should be understood that numerous structural modifications and adaptations may be made without departing from the spirit of the invention.

What is claimed is:

1. In a printer including:

a carriage adapted to be moved along a platen;

a print head mounted in said carriage;

a supply spool idly rotatably mounted in said carriage for feeding an ink ribbon such that said ink ribbon is nipped between said print head and a print paper mounted on said platen during movement of said print head; and a take-up spool rotatably mounted in said carriage for taking up said ink ribbon; wherein said print head is adapted to be pressed against or released from said ink ribbon, and a print operation or an erase operation is performed by moving said print head along said platen maintained in press contact with said ink ribbon while energizing said printhead;

the improvement comprising control means for preventing meandering of the ink ribbon relative to the printhead by temporarily interrupting the printing or erasing of characters within a line thereof by temporarily releasing said print head from said ink ribbon at predetermined intervals corresponding to a plurality of characters to be printed or erased, whereby an adjustment of said ink ribbon may be effected;

said control means comprising;

counter means for counting an amount of successive printing or erasing operations with the print head held in said press contact, said counter means being cleared when said print head is released from said ink ribbon;

reference value memory means for storing a reference value;

comparator means for comparing an amount counted by said counter means with said reference value; and release command output means for outputting a command of releasing the press contact of said print head when it is detected by said comparator means that the amount counted by said counter means reaches said reference value.

2. The printer as defined in claim 4 further comprising a correction blade provided at a predetermined distance from said print head, wherein said correction blade keeps said ink ribbon in contact with said print paper in said distance to allow said ink ribbon heated by said print head to be separated from said print paper at a temperature lower than that of said print head so as to strip off a character or the like having been printed in an erase operation while said correction blade is being pressed against said print paper, and wherein said control means releases said correction blade and said print head from said print paper after a predetermined amount of erasing is successively performed with said correction blade in press contact with said print paper.

3. The printer as defined in claim 1, wherein said take-up spool is adapted to be rotated by the movement of said carriage along said platen for taking up said ink ribbon; and said adjustment of said ink ribbon is to a normal traveling path and is effected by a tension applied to said ink ribbon by a spring.

* * * * *